United States Patent [19]

Ebisui

[11] Patent Number: 4,792,814

[45] Date of Patent: Dec. 20, 1988

[54] CONICAL HORN ANTENNA APPLICABLE TO PLURAL MODES OF ELECTROMAGNETIC WAVES

[75] Inventor: Takashi Ebisui, Kanagawa, Japan

[73] Assignee: Mitsubishi Denki Kabushiki Kaisha, Tokyo, Japan

[21] Appl. No.: 78,669

[22] Filed: Jul. 28, 1987

[30] Foreign Application Priority Data

Oct. 23, 1986 [JP] Japan ..... 61-252405
Oct. 23, 1986 [JP] Japan ..... 61-252406

[51] Int. Cl.[4] ..... H01Q 13/00

[52] U.S. Cl. ..... 343/786; 343/772; 343/783

[58] Field of Search ..... 343/786, 772, 783

[56] References Cited

U.S. PATENT DOCUMENTS

| | | | |
|---|---|---|---|
| 3,662,393 | 5/1972 | Cohn | 343/786 |
| 4,295,142 | 10/1981 | Thiere et al. | 343/786 |
| 4,349,827 | 9/1982 | Bixler et al. | 343/786 |

FOREIGN PATENT DOCUMENTS

| | | | |
|---|---|---|---|
| 0058335 | 5/1979 | Japan | 343/786 |
| 0058336 | 5/1979 | Japan | 343/786 |
| 56-9047 | 2/1981 | Japan . | |
| 58-204604 | 11/1983 | Japan . | |
| 60-17164 | 5/1985 | Japan . | |

OTHER PUBLICATIONS

P. D. Potter, "A New Horn Antenna with Suppressed Sidelobes and Equal Beamwidths", Jun. 1963, pp. 1–8, Microwave Journal.

Seymour B. Cohn, "Flare-Angle Changes in a Horn as a Means of Pattern Control", Oct. 1970, pp. 41–46, Microwave Journal.

IEEE Transactions on Microwave Theory and Techniques, "Conversion of $TE_{11}°$ Mode by a Large Diameter Conical Junction", May 1969, pp. 277–279.

*Primary Examiner*—William L. Sikes
*Assistant Examiner*—Hoanganh Le
*Attorney, Agent, or Firm*—Bernard, Rothwell & Brown

[57] ABSTRACT

A conical horn antenna applicable to plural modes of electromagnetic waves is substantially composed of a feed waveguide positioned on the base end side and feeding a dominant mode of an electromagnetic wave, a conical horn positioned on the fore end side and radiating electromagnetic waves of plural modes including dominant and higher modes, and a desired mode of electromagnetic wave generating portion provided between the feed waveguide and the conical horn and generating an electromagnetic wave of a desired higher mode. The electromagnetic wave generating portion is composed of straight cylindrical waveguides having the same or different inside diameters and having a predetermined relation to the wavelength of maximum frequency and that of minimum frequency in a certain frequency band, and tapered waveguides which connect stages of said straight cylindrical waveguides, a feed waveguide and a conical horn, respectively, through truncated cone-like inner peripheral surfaces thereof and which expand forwardly from the base end side. The tapered waveguide adjacent to the feed waveguide may be constructed of two tapered portions having a gentle expansion angle on the base end side and a sharp expansion angle on the fore end side.

6 Claims, 6 Drawing Sheets

CONICAL HORN ANTENNA APPLICABLE TO PLURAL MODES OF ELECTROMAGNETIC WAVESn

BACKGROUND OF THE INVENTION

1. Field of the Invention

The present invention relates to a conical horn antenna applied to, for example, a primary horn of a reflector antenna or an electromagnetic horn antenna itself. More particularly, the invention is concerned with a conical horn antenna (hereinafter referred to as "plural mode horn antenna") used for and excited by plural modes of electromagnetic waves, including an electromagnetic wave of $TE_{11}$ mode which is a dominant mode of a circular waveguide constituting a conical horn and higher modes of electromagnetic waves.

2. Description of the Prior Art

The horn antenna is known as an antenna capable of affording relatively high gain in spite of the simple structure, and various attempts have been made to improve the radiation characteristic of the horn. Moreover, a horn which has been improved to obtain a high gain is often used as a primary radiator of another aperture antenna.

FIGS. 1 and 2 are schematic sectional views showing examples of conventional plural mode horn antennas disclosed in Japanese Patent Publication No. 9047/81.

The plural mode horn antenna shown in FIG. 1 is composed of a feed waveguide 1 for feeding an electromagnetic wave of the basic $TE_{11}$ mode, a desired mode of electromagnetic wave generating portion 2 connected to the feed waveguide 1 for generating a magnetic transversal wave of $TM_{11}$ mode, and a truncated cone-like conical horn 3 connected to the desired mode of electromagnetic wave generating portion 2. The desired mode generating portion 2 is composed of a tapered waveguide 4 expanding from the feed waveguide 1 toward the conical horn 3 and a straight cylindrical waveguide 5 which connects the tapered waveguide 4 and the conical horn 3 with each other. Such a shape of a conical horn antenna is called a flare type plural mode horn antenna in view of its tapered shape.

The operation of the conventional plural mode horn antenna of the above construction will now be described. A portion of the electromagnetic wave of $TE_{11}$ mode as the dominant mode fed from the feed waveguide 1 is converted to an electromagnetic wave of $TM_{11}$ mode as a desired mode at the discontinuous portions of the connection of the tapered waveguide 4 and the straight cylindrical waveguide 5 and of the connection of the waveguide 5 and the conical horn 3. The size of the conical horn 3 is determined by obtaining a desired radiation pattern, while the inside diameter of the straight cylindrical waveguide 5 is determined by diminishing the occurrence of unnecessary higher modes. Therefore, a desired amount of electromagnetic wave of $TM_{11}$ mode to be generated and that of phase thereof can be obtained by selecting an optimum relation between the length of the straight cylindrical portion of the straight cylindrical waveguide 5 and the expansion angle of the tapered waveguide 4. Further, a radiation pattern reduced in the proportion of a cross polarization component can be obtained by adopting a shape which is symmetric rotationally.

However, in the above so-called flare type plural mode horn antenna having the tapered waveguide 4, it has been impossible to obtain good radiation characteristics in a wide frequency band.

In an effort to overcome the above problem, there has been proposed a so-called flare iris type plural mode horn antenna, as shown in FIG. 2, in which in addition to the tapered waveguide 4, iris diaphragms (hereinafter referred to simply as "irises") 6 as circumferential projections are formed in plural stages on the inner peripheral surface of the straight cylindrical waveguide 5. In the example shown in FIG. 2, the above irises 6 comprise a first iris *6a* and a second iris *6b* which are arranged in two stages. The operation of this flare iris type plural mode horn antenna will now be described. Like the foregoing antenna show in FIG. 1, an electromagnetic wave fed through the discontinuous shape from the tapered waveguide 4 to the conical horn 3 via the straight cylindrical waveguide 5 is converted to the electromagnetic wave of $TM_{11}$ mode, and also from irises 6 there is generated the electromagnetic wave of $TM_{11}$ mode, which wave is propagated toward the conical horn 3 and also toward the tapered waveguide 4, namely, in the flare direction. The electromagnetic wave in the direction of the tapered waveguide 4 is reflected by the tapered inner surface and transmitted toward the conical horn 3. Therefore, by suitably selecting the sizes of the tapered waveguide 4, straight cylindrical waveguide 5 and irises 6 there can be ottained an electromagnetic wave of $TM_{11}$ mode over a wide frequency band in a desired amount thereof generated and that of phase thereof.

Further, there has also been proposed a desired mode of electromagnetic wave generating portion 2 in which the flare portion and the straight cylindrical waveguide portion formed with iris in the flare iris type plural mode horn antenna of FIG. 2 are provided in plural stages as shown in FIG. 3. This plural mode horn antenna illustrated in the schematic sectional view of FIG. 3 is disclosed in Japanese Patent Publication No. 17164/85. In the said figure, the desired mode of electromagnetic wave generating portion 2 is composed of a first tapered waveguide 4, a first straight cylindrical waveguide 5, a second tapered waveguide 7 and a second straight cylindrical waveguide 8. On the inner peripheral srrface of the first straight cylindrical waveguide 5 are formed irises *6a* and *6b* as circumferential projections, and the second straight cylindrical waveguide 8 is also formed with irises *6c* and *6d*. The irises *6a* to *6d* are axially provided metallic bands which are symmetric rotationally with respect to the axes of the first and second straight cylindrical waveguides 5 and 8. The inside diameter of the first straight cylindrical waveguide 5 is set at a size which permits transmission of an electromagnetic wave of $TE_{11}$ mode but does not permit transmission of $TE_{12}$ mode electromagnetic wave, while the inside diameter of the second straight cylindrical waveguide 8 is set at a size permitting transmission of the $TE_{12}$ mode electromagnetic wave.

In the plural mode horn antenna of the above construction, an electromagnetic wave of $TM_{11}$ mode is generated by both end portions of the first straight cylindrical waveguide 5 and discontinuous portions formed by the irises *6a* and *6b*. Further, electromagnetic waves of $TM_{11}$ and $TM_{12}$ modes are generated by both end portions of the second straight cylindrical waveguide 8 and discontinuous portions formed by the irises *6c* and *6d*. By controlling these two higher modes there are obtained good electromagnetic wave radiation characteristics over a wide range of frequency band.

FIG. 4 is a schematic sectional view of a further conventional plural mode horn antenna which is disclosed, for example, in Japanese Patent Laid Open No. 204604/83. In the horn antenna shown therein, a desired mode of electromagnetic wave generating portion 2 comprises first and second tapered waveguides 4 and 7 as well as first and second straight cylindrical waveguides 5 and 8, which are connected in an alternate fashion. A first feed waveguide 1 feeds electromagnetic waves belonging to a high frequency band. To the second tapered waveguide 7 is connected a second feed waveguide 9. In the illustrated example, two feed waveguides 9*a* and 9*b* are open to the tapered surface in opposed positions. These second feed waveguides 9*a* and 9*b* feed electromagnetic waves belonging to a low frequency band.

The plural mode horn antenna constructed as above is used in both low and high frequency bands. The inside diameter of the first straight cylindrical waveguide 5 is set at a size which permits transmission of only electromagnetic waves of $TE_{11}$ and $TM_{11}$ modes belonging to the high frequency band, not permitting transmission of $TE_{12}$ mode electromagnetic wave, and which prevents the electromagnetic waves in the low frequency band fed from the second feed waveguides 9*a* and 9*b* attached to the second tapered waveguide 7, from being transmitted in the direction of the first straight cylindrical waveguide 5. The inside diameter of the second straight cylindrical waveguide 8 is set at a size which permits transmission of elecrromagnetic waves of not only $TE_{11}$ and $TM_{11}$ modes in the high frequency band but also the same modes in the low frequency band. Thus, in the plural mode horn antenna shown in FIG. 4, the first tapered waveguide 4 and the straight cylindrical waveguide 5 can be designed in conformity with the high frequency band, and the second tapered waveguide 7 and the straight cylindrical waveguide 8 in conformity with the low frequency band. Consequently, good electromagnetic wave radiation characteristics can be obtained in a wide frequency range including both frequency bands.

In addition to the above four examples of conventional plural mode horn antennas, there are the following several examples of prior art literatures described in English:

(1) "A New Antenna with Suppressed Sidelobes and Equal Beamwidths", written by P. D. Potter, reprinted from MICROWAVE JOURNAL, June, 1963.

(2) "Flare-Angle Changes in a Horn as a Means of Pattern Control" written by DR. SEYMOUR B. COHN, the Microwave Journal, October, 1970.

(3) "Conversion of $TE_{11}$ Mode by Large Diameter Conical Junction", IEEE TRANSACTIONS ON MICROWAVE THEORY AND TECHNIQUES, MAY, 1969.

The conventional plural mode horn antennas described above using FIGS. 1 to 4 have involved the following problems.

First, in the conventional examples shown in FIGS. 1 and 2, a large expansion angle of the tapered waveguide 4 results in poor matching with the feed waveguide 1 and deterioration of the standing wave ratio because the angle of the tapered waveguide 4 of the desired mode of electromagnetic wave generating portion connected to the feed waveguide 1 is determined to obtain a desired mmount of an electromagnetic wave of a desired mode, e.g. $TM_{11}$ mode, to be generated and that of phase thereof.

There has also been the problem that if the expansion angle of the tapered waveguide 4 is set small in order to improve the standing wave ratio, the aforementioned amounts in the desired mode cannot be obtained.

In the plural mode horn antenna shown in FIG. 3, moreover, since electrically it is necessary to generate electromagnetic waves of $TM_{11}$ and $TE_{12}$ modes in addition to the dominant mode and control the three modes simultaneously, it has been difficult to design an antenna having good radiation characteristics over a wide frequency range including a low frequency band, e.g. from 12.25 GHz to 12.75 GHz, and a high frequency band, e.g. from 14.0 GHz to 14.5 GHz. Also mechanically there has been the problem that the production is difficult because it is necessary to form annular and band-like irises 6 . . . on the inner peripheral surfaces of the first and second straight cylindrical waveguides 5 and 7.

Further, in the plural mode horn antenna shown in FIG. 4, there have been the following problems electrically and mechanically although good radiation characteristics can be obtained in a wide frequency range including low and high frequency bands. First, electrically, an electromagnetic wave of a low frequency band is prevented from being transmitted through the first straight cylindrical waveguide 5, while allowing an electromagnetic wave of a high frequency band, e.g. $TM_{11}$ mode electromagnetic wave, to pass therethrough, so the low and high frequency bands are restricted in the frequency ratio. Mechanically, moreover, there has been the problem that the structure of the horn antenna becomes complicated because it is necessary to separately provide the second feed waveguide 9 which communicates with the inner tapered surface of the second tapered waveguide 7 and which is for feeding electromagnetic waves belonging to the low frequency band.

SUMMARY OF THE INVENTION

It is a first object of the present invention to provide a plural mode horn antenna in which a desired mode of electromagnetic wave generating portion positioned between a feed waveguide and a conical horn is preset to desired internal shape and structure, whereby a desired amount of an electromagnetic wave of a desired mode generated and that of phase thereof are obtained in a constant state; besides, even when the expansion angle of a tapered waveguide is large, there is ensured good matching thereof with the feed waveguide and the standing wave ratio can be improved.

It is a second object of the present invention to provide a plural mode horn antenna having improved internal shape and structure of a desired mode of electromagnetic wave generating portion, thereby dispensing with the provision of a band-like iris, capable of attaining ease of manufacture from the mechanical and productive standpoint, and exhibiting good radiation characteristics in both a high frequency band, e.g. 14.0–14.5 GHz, and a low frequency band, e.g. 12.25–12.75 GHz, from the electrical standpoint.

It is a third object of the present invention to provide a plural mode horn antenna so constructed as to permit generation of desired modes of electromagnetic waves in good condition in both high and low frequency bands even without providing a second feed waveguide which opens to the inner peripheral surface of any of tapered waveguides provided in plural stages in a desired mode of electromagnetic wave generating portion, whereby electrically the frequency ratio in each of the high and low frequency bands can be made variable and mechanically it is possible to simplify the structure and the manufacturing step.

According to the plural mode horn antenna of the present invention provided for achieving the above-mentioned objects, a desired mode of electromagnetic wave generating portion provided between a feed waveguide positioned on the base end side and a conical horn positioned on the fore end side has a structure in which there are arranged successively a first tapered waveguide expanding from the feed waveguide side toward the front end side into a diameter of a length certain times as large as the wavelength of maximum frequency, a first straight cylindrical waveguide which aas a diameter corresponding to the expansion diameter of the first tapered waveguide and which generates an electromagnetic wave of a desired mode in a high frequency band, a second tapered waveguide expanding from the fore end side of the first straight cylindrical waveguide at a length certain times as large as the wavelength of maximum frequency in a low frequency band, and a second straight cylindrical waveguide which is extended to the front end side at the expansion diameter of the second tapered waveguide and which generates an electromagnetic wave of a desired mode in a low frequency band. In the present invention, moreover, if required there is provided between the base end-side feed waveguide and the desired mode of electromagnetic wave generating portion a reflection preventing waveguide having a truncated cone-like peripheral surface inclined at an angle smaller than the expansion angle of the first tapered waveguide.

DETAILED DESCRIPTION OF THE PREFERRED EMBODIMENTS

Plural mode horn antennas according to preferred embodiments of the present invention will be described in detail hereinafter with reference to the accompanying drawings.

Figure 5:
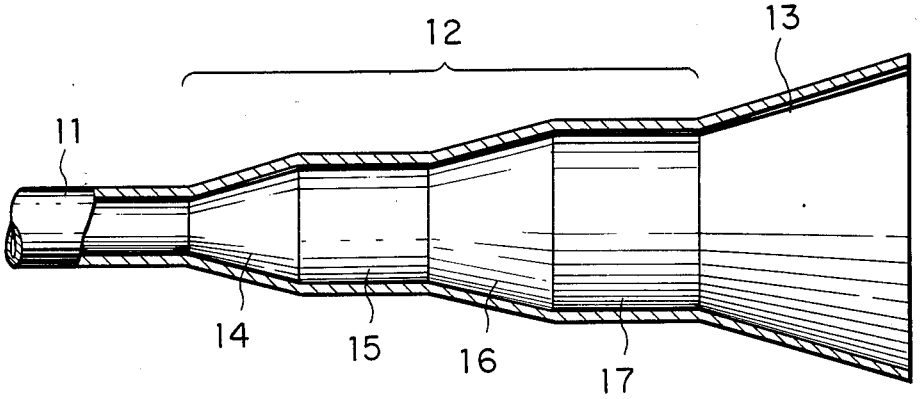
FIG. 5 is a schematic sectional side view of a plural mode horn antenna according to a first embodiment of the present invention.

FIG. 5 is a schematic sectional side view of a plural mode horn antenna according to a first embodiment of the present invention. This plural mode horn antenna is composed of a feed waveguide 11, a desired mode of electromagnetic wave generating portion 12 and a conical horn 13. The desired mode of electromagnetic wave generating portion 12 comprises first and second tapered waveguides 14 and 16 and first and second straight cylindrical waveguides 15 and 17. These approximately correspond to those of the conventional horn antennas, provided their inside diameters are determined so that dominant modes of electromagnetic waves belonging to low and high frequency bands are fed to the feed waveguide 11, so that the dominant modes of electromagnetic waves in both frequency bands and only $TM_{11}$ mode electromagnetic wave in the high frequency band are propagated to the first cylindrical waveguide 15 and so that $TE_{12}$ mode and $TM_{11}$ mode of electromagnetic waves in the high and low frequency bands, as well as the dominant modes of electromagnetic waves in both frequency bands and $TM_{11}$ mode of electromagnetic wave in the high frequency band, are propagated to the second straight cylindrical waveguide 17.

Figure 6:
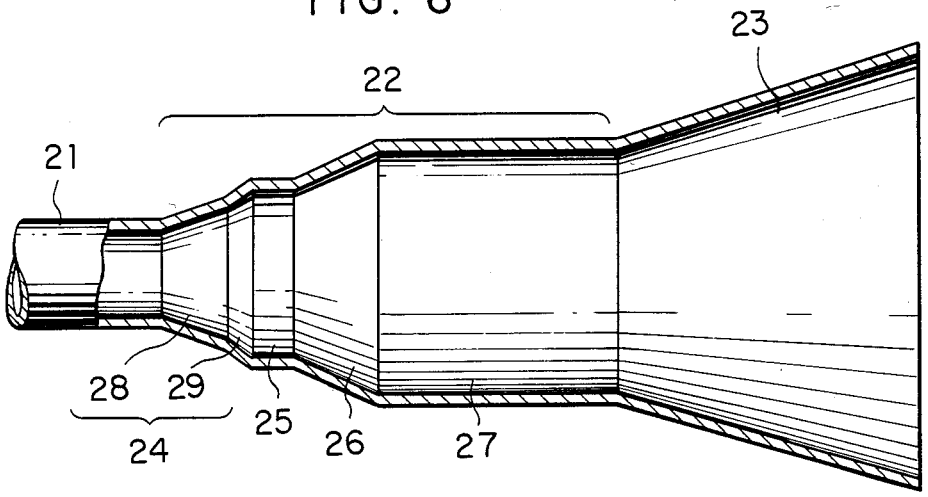
FIG. 6 is a schematic sectional side view of a plural mode horn antenna according to a second embodiment of the present invention.

Referring now to FIG. 6, there is illustrated a plural mode horn antenna according to a second embodiment of the present invention. This plural mode horn antenna is substantially composed of a feed waveguide 21, a desired mode of electromagnetic wave generating portion 22 and a conical horn 23. The desired mode of electromagnetic wave generating portion 22 is composed of a first tapered waveguide 24, a first straight cylindrical waveguide 25, a second tapered waveguide 26, and a second straight cylindrical waveguide 27. In this embodiment, the first tapered waveguide 24 comprises a gently tapered waveguide 28 expanding at a gentle inclination angle and a sharply tapered waveguide 29 expanding at a sharp angle, the waveguide 29 generating a higher mode of electromagnetic wave in a high frequency band.

Figure 8:
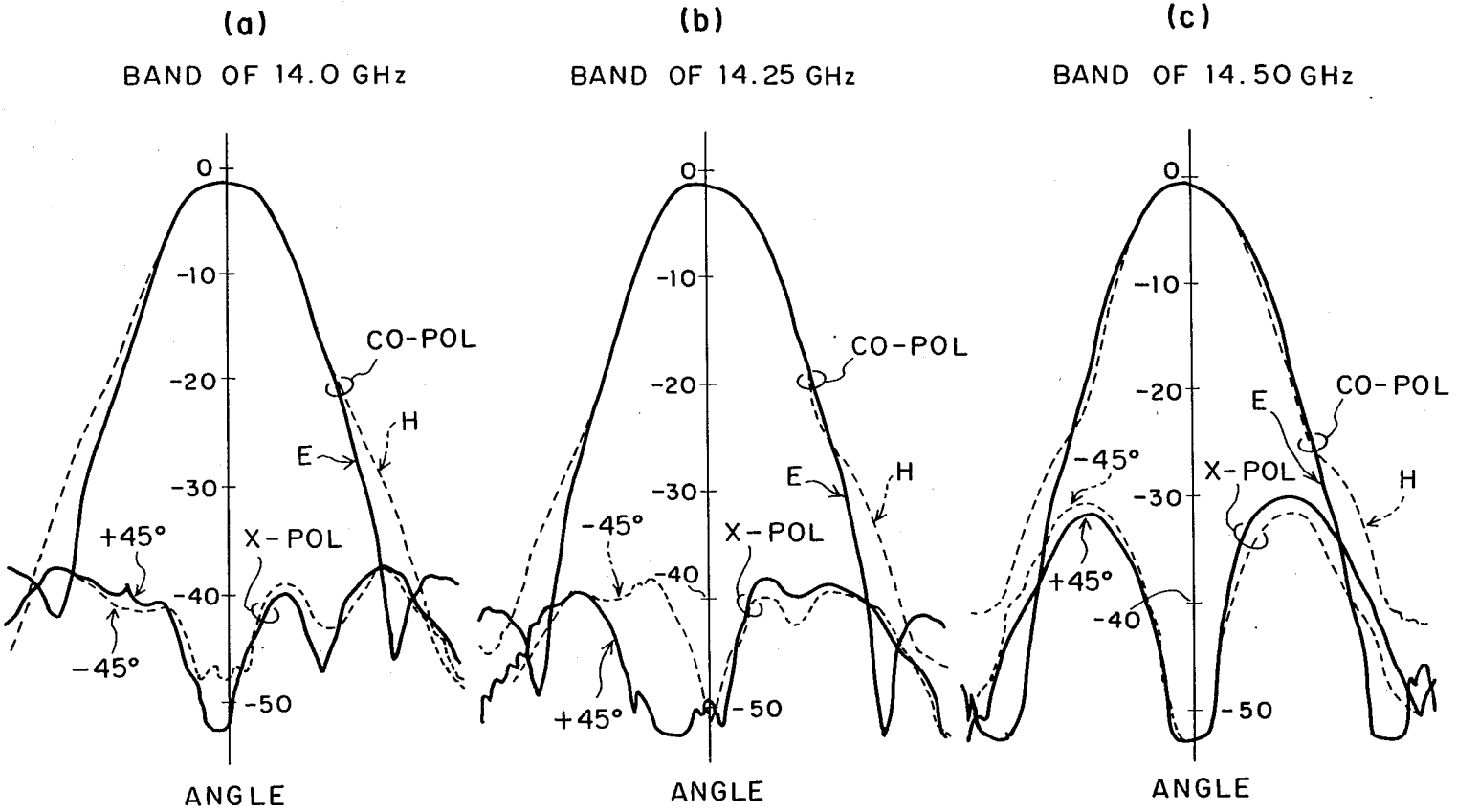
FIGS. 8(*a*), (*b*) and (*c*) are characteristics diagrams showing characteristics of electromagnetic waves in a high frequency band of the plural mode horn antenna of the invention.
Figure 9:
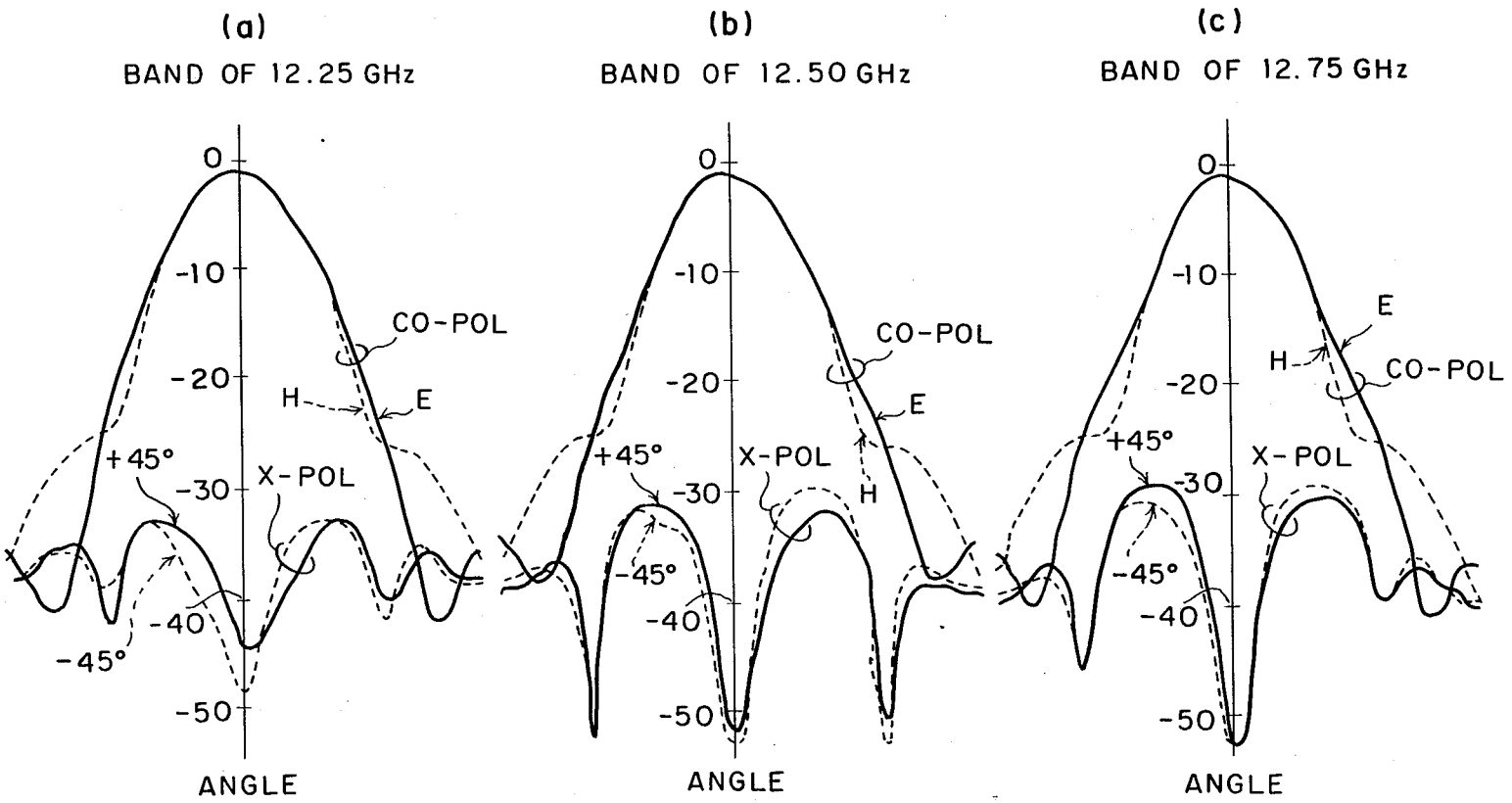
FIGS. 9(*a*), (*b*) and (*c*) area characterstics diagrams showing characteristics of electromagnetic waves in a low frequency band of the plural mode horn antenna of the invention.

Such horn antennas according to the first and second embodiments are used in two frequency bands which are a low frequency band (e.g. 12.25 GHz–12.75 GHz) as shown in FIGS. 9(*a*), (*b*) and (*c*) and a high frequency band (e.g. 14.0 GHz–14.5 GHz) as shown in FIGS. 8(*a*), (*b*) and (*c*), both being fed from the feed waveguides 11 and 21. An electromagnetic wave of $TE_{11}$ mode as the dominant mode fed from each of the feed waveguides 11 and 21 is converted to a higher mode of for example $TM_{11}$ mode or $TE_{12}$ mode at the discontinuous portions of both ends of the first and second straight cylindrical waveguides 15 or 25 and 17 or 27 by suitably selecting the value of inside diameter of each said straight cylindrical waveguide.

In this connection, a radiation pattern of a cross polarization component obtained when such horn antenna is excited in the $TE_{11}$ mode and a radiation pattern obtained in the excitation in the $TM_{11}$ mode or $TE_{12}$ mode are almost similar in shape to each other. Therefore, the cross polarization component in the $TE_{11}$ mode can be cancelled by suitably selecting the amounts of $TM_{11}$ and $TE_{12}$ mode electromagnetic waves generated and those of their phases. Further, the radiation pattern of a main polarization component can be made symmetric rotationally.

On the other hand, higher modes capable of being propagated through a straight cylindrical waveguide having an inside diameter of D are available when the wavelength λ satisfies the following relationship (1):

$$\lambda < \frac{\pi D}{ka} \quad (1)$$

$$D > \frac{ka\lambda}{\pi} \quad (2)$$

In the above expressions, ka represents the root of a characteristic equation and it is given as follows for each mode:

$$\left.\begin{array}{l} TE_{11} \text{ mode, } ka_0 = 1.84 \\ TM_{11} \text{ mode, } ka_1 = 3.83 \\ TE_{12} \text{ mode, } ka_2 = 5.33 \end{array}\right] \quad (3)$$

Here an inside diameter $d_0$ is determined so that only $TE_{11}$ mode in the high and low frequency bands are propagated through the feed waveguide 11 or 21 and the propagation of the above higher modes is prevented. More specifically, it is necessary to select an appropriate value of the inside diameter $d_0$ within a range larger than the value 0.586 ($ka_0/\pi$) times the wavelength $\lambda_4$ of a minimum frequency of the low frequency band according to the expressions (2) and (3) to permit the propagation of $TE_{11}$ mode in both frequency bands or smaller than the value 1.22 ($ka_1/\pi$) times the wavelength $\lambda_1$ of a maximum frequency of the high frequency band to prevent the propagation of the above higher modes. That is:

$$0.586\lambda_4 < d_0 < 1.22\lambda_1 \quad (4)$$

Then, an inside diameter $d_1$ is determined so that only $TM_{11}$ mode in the high frequency band is propagated through the first straight cylindrical waveguide 15 or 25. More specifically, it is necessary to select an appropriate size, according to the expressions (2) and (3), within a range larger than the value 1.22 ($ka_1/\pi$) times the wavelength $\lambda_2$ of a minimum frequency of the high frequency band in order to propagate $TM_{11}$ mode in the high frequency band, or smaller than the value 1.70 ($ka_2/\pi$) times the wavelength $\lambda_1$ of maximum frequency of the high frequency band in order to prevent the propagation of $TE_{12}$ mode in the high frequency band, or smaller than the value 1.22 ($ka_1/\pi$) times the wavelength $\lambda_3$ of maximum frequency of the low frequency band in order to prevent the propagation of $TM_{11}$ mode in the low freuuency band. That is:

$$\left.\begin{array}{r} 1.22\lambda_2 < d_1 < 1.70\lambda_1 \\ d_1 < 1.22\lambda_3 \end{array}\right] \quad (5)$$

Next, an inside diameter $d_2$ is determined to permit the propagation of $TM_{11}$ mode in the low frequency band as well as $TM_{11}$ and $TE_{12}$ modes through the second straight cylindrical waveguide 17 or 27. More specifically, it is necessary to select, according to the expressions (2) and (3), an appropriate value within a range larger than the value 1.22 ($ka_1/\pi$) times the wavelength $\lambda_4$ of a minimum frequency of the low frequency band in order to propagate $TM_{11}$ mode in the low frequency band, or larger than the value 1.70 ($ka_2/\pi$) times the wavelength $\lambda_2$ of a minimum frequency of the high frequency band in order to propagate $TE_{12}$ mode in the high frequency band, or smaller than the value 1.70 ($ka^2/\pi$) times the wavelength $\lambda_3$ of a maximum frequency of the low frequency band in order to prevent the propagation of $TE_{12}$ mode in the low frequency band. That is:

$$\left.\begin{array}{l} 1.22\lambda_4 < d_2 < 1.70\lambda_3 \\ 1.70\lambda_2 < d_2 \end{array}\right] \quad (6)$$

For example, if the high frequency band ranges from 14.0 to 14.5 GHz as shown in FIGS. 8(*a*), (*b*) and (*c*) and the low frequency band ranges from 12.25 to 12.75 GHz as shown in FIGS. 9(*a*), (*b*) and (*c*), then:

$$\left.\begin{array}{l} \lambda_1 = 20.69 \text{ mm} \\ \lambda_2 = 21.43 \text{ mm} \\ \lambda_3 = 23.53 \text{ mm} \\ \lambda_4 = 24.49 \text{ mm} \end{array}\right] \quad (7)$$

So the inside diameter $d_0$ of the feed waveguide 11 or 21, the inside diameter $d_1$ of the first straight cylindrical waveguide 15 or 25 and the inside diameter $d_2$ of the second straight cylindrical waveguide 17 or 27 may be determined to values within the following ranges:

$$\left.\begin{array}{l} 14.35 \text{ mm} < d_0 < 25.24 \text{ mm} \\ 26.14 \text{ mm} < d_1 < 28.71 \text{ mm} \\ 36.43 \text{ mm} < d_2 < 40.00 \text{ mm} \end{array}\right] \quad (8)$$

Figure 7:
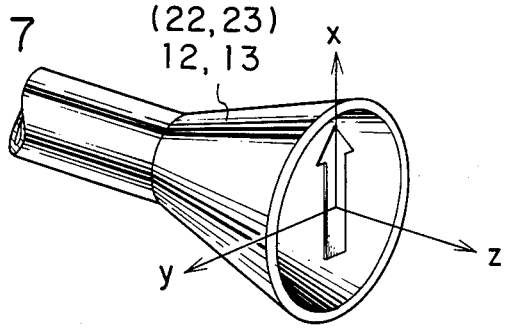
FIG. 7 is a schematic perspective view showing an electromagnetic wave radiated from the plural mode horn antenna of the invention.

In the plural mode horn antenna thus constructed, the second tapered waveguide 16 or 26 and the second straight cylindrical waveguide 17 or 27 are designed so that a desired amount of $TM_{11}$ mode generated and that of phase thereof are obtained in the low frequency band. Next, taking into account the amounts of $TM_{11}$ and $TE_{12}$ modes in the high frequency band generated in those portions as well as the amounts of their phases, the first tapered waveguide 14 or 24 and the first straight cylindrical waveguide 15 or 25 are designed so that a desired amount of $TM_{11}$ mode generated and that of phase thereof are obtained in the high frequency band. Thus, it is possible to obtain desired amounts of $TM_{11}$ and $TE_{12}$ modes and of their phases in both low and high frequency bands. Consequently, in both frequency bands there can be obtained good radiation patterns reduced in the proportion of a cross polarization component and symmetric rotationally (see FIG. 7).

In the above description, there has been explained the case of using a straight cylindrical waveguide which does not axially change in its diameter. However, the same effect can be obtained by using a tapered waveguide which has a small opening angle less than one degree or so, instead of the above straight cylindrical waveguide. In this case, the horn antenna shaped as above can be made up by casting and so on, so there is provided an advantage that the horn antenna has low manufacturing cost.

Figure 1:
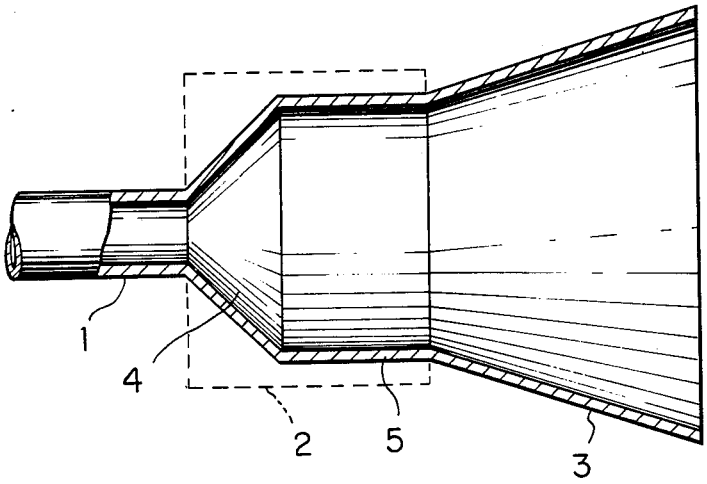
FIG. 1 (PRIOR ART)
FIG. 1 is a schematic sectional side view showing an example of a conventional plural mode horn antenna.
Figure 2:
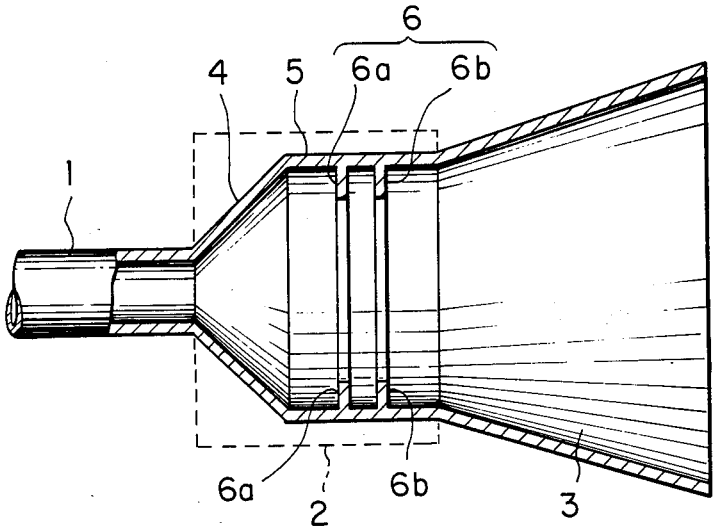
FIG. 2 (PRIOR ART)
FIG. 2 is a schematic sectional side view showing another example of a conventional plural mode horn antenna.
Figure 3:
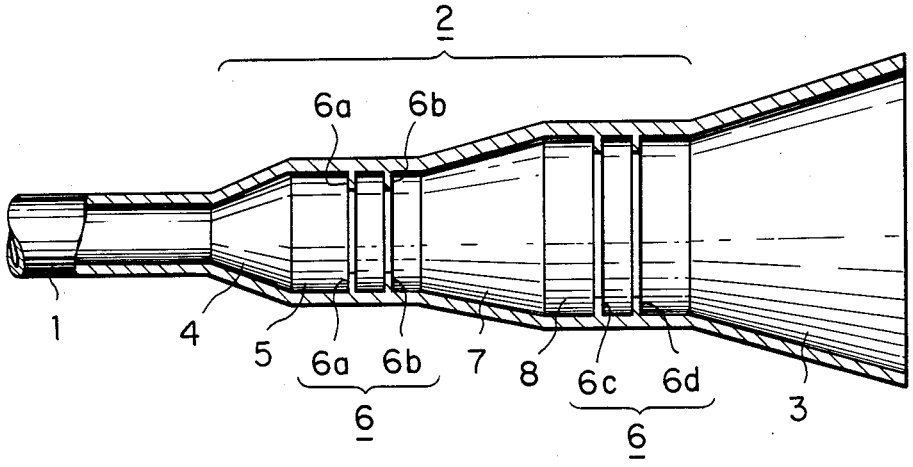
FIG. 3 (PRIOR ART)
FIG. 3 is a schematic sectional side view showing a further example of a conventional mode horn antenna.
Figure 4:
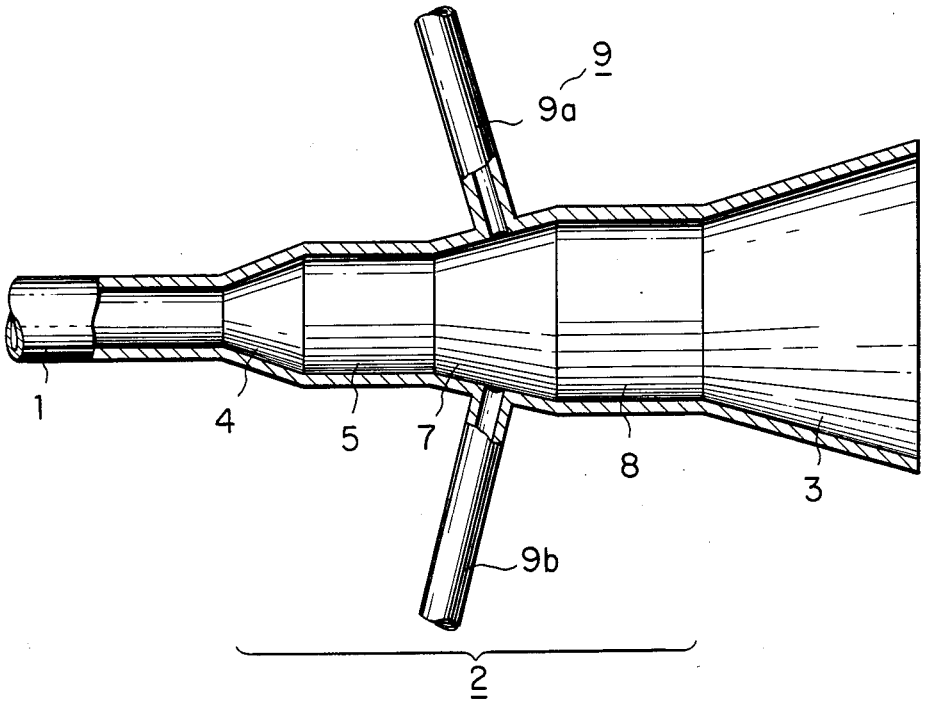
FIG. 4 (PRIOR ART)
FIG. 4 is a schematic sectional side view showing a still further example of a conventional plural mode horn antenna.
Figure 10:
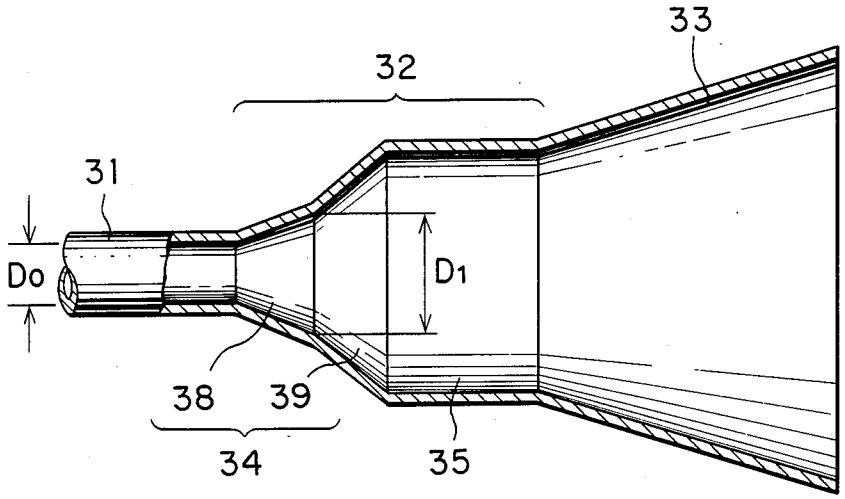
FIG. 10 is a schematic sectional side view showing a plural mode horn antenna according to a third embodiment of the present invention.

The details of the gentle and sharp waveguides having gentle and sharp expansion angles applied to the first tapered waveguide 24 in the above second embodiment will now be described in the form of a third embodiment. FIG. 10 is a sectional side view showing a third embodiment of the present invention applied to a flare type plural mode horn antenna. In this figure, the reference numerals 31 to 35 represent almost the same components as in the conventional flare type plural mode horn antennas shown in FIGS. 1 and 2. A tapered waveguide 34 is composed of a gently tapered waveguide 38 positioned on the side of a feed waveguide 31 and a sharply tapered waveguid 39 positioned on the fore end side.

In this third embodiment, an inside diameter $D_1$ on the feed waveguide 31 side of the sharply tapered waveguide 39 of a $TM_{11}$ mode generating portion 32 as a desired mode of electromagnetic wave generating portion is set larger than the inside diameter $D_0$ of the feed waveguide 31 and smaller than the value 1.22 times the wavelength $\lambda_m$ of a maximum frequency of the frequency band used, and the gently tapered waveguide 38 is provided which connects the inner wall of the feed waveguide 31 and that of the sharply tapered waveguide 39 smoothly with each other.

In general, higher modes capable of being propagated through a straight cylindrical waveguide having an inside diameter of D are available when the wavelength $\lambda$ satisfies the following expression (9):

$$\lambda < \frac{\pi D}{ka} \tag{9}$$

$$D > \frac{ka\lambda}{\pi} \tag{10}$$

In the above expressions, ka represents the root of a characteristic equation and it is given as follows for each mode:

$$\left.\begin{array}{l} TE_{11}\text{ mode, } ka_0 = 1.84 \\ TM_{11}\text{ mode, } ka_1 = 3.83 \end{array}\right] \tag{11}$$

From the above it is seen that the propagation of $TM_{11}$ mode through the gently tapered waveguide 38 is prevented by making the inside diameter $D_1$ of the connection of the waveguide 38 and the sharply tapered waveguide 39 smaller than the value $ka_1/\pi$ or 1.22 times the wavelength 80 $_m$ of maximum frequency of the frequency band used.

Therefore, $TE_{11}$ mode propagated from the feed waveguide 31 toward a conical horn 33 passes through the gently tapered waveguide 38, whereby it is propagated smoothly to $TM_{11}$ mode generating portion 32, so that reflection can be diminished. That is, in comparison with the conventional structure in which the mode propagation is made from the feed waveguide directly to the $TM_{11}$ mode generating portion 32, it is possible to reduce the size of discontinuance of the connection of the feed waveguide 31 and the gently tapered waveguide 38 and also of the connection of the gently tapered waveguide 38 and the sharply tapered waveguide 39. Moreover, as to the connection of the gently tapered waveguide 38 and the sharply tapered waveguide 39, it is possible to make the flare angle small by enlarging the inside diameter of that discontinuous portion, thus permitting the standing wave ratio to be improved and the reflection diminished.

Further, by setting the inside diameter of the gently tapered waveguide 38 at a value smaller than the value 1.22 times the wavelength of a maximum frequency of the frequency band used, it is made possible to suppress the propagation of $TM_{11}$ mode generated in both end connections of the gently tapered waveguide 38, so the influence upon the amount of $TM_{11}$ mode generated and that of phase thereof can be diminished, thus making it possible to obtain a desired radiation pattern.

Although one gently tapered waveguide is used in the above description, the same effect can be obtained even when plural such waveguides are connected. Further, although reference was made to flare type and flare iris type plural mode horn antennas in the above description, there can be obtained the same effect even when the invention is applied to other types of plural mode horn antennas.

According to the present invention, as set forth in detail hereinabove, it is possible to obtain desired amounts of $TM_{11}$ and $TE_{12}$ modes generated and of phases thereof in both low and high frequency bands, so a satisfactory radiation pattern reduced in the proportion of a cross polarization component and symmetric rotationally can be obtained in both such frequency bands. Besides, it is possible to attain a simple structure and easy manufacture because feed is made using a single feed waveguide for both frequency bands and it is not necessary to provide projections inside the antenna.

According to the present invention, moreover, since a gently tapered waveguide capable of feeding $TE_{11}$ mode smoothly without generating any unnecessary higher mode is inserted between the feed waveguide and the $TM_{11}$ mode generating portion, it is possible to obtain a plural mode horn antenna reduced in reflection power and having a small standing wave ratio.

What is claimed is:

1. A plural mode horn antenna having a desired mode of electromagnetic wave generating portion for generating a desired mode(s) of electromagentic wave(s) out of plural modes of electromagnetic waves in a position between a feed waveguide located on a base end side and a conical horn located on a fore end side, said plural mode horn antenna comprising a first tapered waveguide connected to the fore end side of said feed waveguide and expanding at a predetermined certain angle while defining an inner peripheral surface of a truncated cone from an inside diameter thereof equal to the inside diameter of said feed waveguide up to an inside diameter certain times as large as a predetermined wavelength of the frequency of an electromagnetic wave of a mode to be generated;

a first straight cylindrical waveguide connected to the fore end side of said first tapered waveguide and extending forward in the form of a cylindrical inner peripheral surface having an inside diameter larger than 1.22 times the wavelength of a minimum frequency of a high frequency band to which the electromagnetic wave of said mode to be generated belongs, smaller than 1.7 times the wavelength of the maximum frequency of said high-frequency band, and smaller than 1.22 times the wavelength of a maximum frequency of a low frequency band;

a second tapered waveguide connected to the fore end side of said first straight cylindrical waveguide and expanding at a certain angle while defining an inner peripheral surface of a truncated cone from an inside diameter thereof equal to the inside diameter of said first straight cylindrical wave guide up to an inside diameter thereof certain times as large as a predetermined wavelength of a frequency different from that of said mode of electromagnetic wave; and a second straight cylindrical waveguide connected between the fore end side of said second tapered waveguide and the base end side of said conical horn and having an inside diameter certain times as large as said predetermined wavelength of the frequency different from that of said mode of electromagnetic wave, said inside diameter of said second straight cylindrical waveguide being larger than 1.22 times the wavelength of a minimum frequency of said low frequency band, smaller than 1.7 times the wavelength of the maximum frequency of said low frequency band, and larger than 1.7 times the wavelength of the minimum frequency of said high frequency band.

2. A plural mode horn antenna according to claim 1, wherein the antenna is used in two high and low frequency bands belonging to a microwave or millimeter wave band and is excited by electromagnetic waves of plural modes which are $TE_{11}$ mode as a dominant mode fed from said feed waveguide and higher modes, wherein said first straight cylindrical waveguide is constructed to permit the propagation therethrough of only an electromagnetic wave of $TE_{11}$ mode as the dominant mode in both said frequency bands and that of $TM_{11}$ mode as a higher mode in said high frequency band, and wherein said second straight cylindrical waveguide is constructed to permit the propagation therethrough of an electromagnetic wave of $TE_{12}$ mode as a higher mode in said high frequency band and that of $TM_{11}$ mode as a higher mode in said low frequency band in addition to the electromagnetic waves of said $TE_{11}$ and $TM_{11}$ modes travelling through said first straight cylindrical waveguide.

3. A plural mode horn antenna according to claim 1, wherein said first tapered waveguide positioned on the base end side of said desired mode of electromagnetic wave generating portion is composed of a gently tapered waveguide connected to the fore end side of said feed waveguide and expanding forward at a gentle angle from its base end side having the same inside diameter as that of the feed waveguide, and a sharply tapered waveguide positioned between the fore end side of said gently tapered waveguide and said first straight cylindrical waveguide and expanding forward at a sharp angle.

4. A plural mode horn antenna according to claim 1, wherein said first straight cylindrical waveguide is set to permit the propagation therethrough of dominant and higher modes of electromagnetic waves in a high frequency band of 14.0 to 14.5 GHz, and said second straight cylindrical waveguide is set to permit the propagation therethrough of a higher mode of an electromagnetic wave in addition to said electromagnetic waves propagated through said first straight cylindrical waveguide.

5. A plural mode horn antenna comprising:

a feed waveguide provided on a base end side for feeding a dominant mode of an electromagnetic wave;

a conical horn provided on a fore end side, said conical horn having a truncated cone-like tapered inner peripheral surface for radiating plural modes of electromagnetic waves as antenna output;

a desired mode of electromagnetic wave generating portion for generating a desired higher mode of electromagnetic wave on the basis of said dominant mode of electromagnetic wave, said desired mode of electromagnetic wave generating portion comprising a tapered waveguide provided between said feed waveguide and said conical horn, said tapered waveguide having a truncated cone-like inner peripheral surface expanding forward at a predetermined angle from its base end portion which is of the same inside diameter as that of said feed waveguide, and a straight cylindrical waveguide having a cylindrical inner peripheral surface extending forward from the fore end side of said tapered fore end side, the electromagnetic wave of the dominant mode fed from said feed waveguide being the $TE_{11}$ mode electromagnetic wave, and the higher mode of electromagnetic wave generated in said cylindrical waveguide being the $TM_{11}$ mode electromagnetic wave;

said tapered waveguide of said desired mode of electromagnetic wave generating portion comprising a first tapered portion and a second tapered portion, said first tapered portion being a gently tapered waveguide connected to the fore end side of said feed waveguide and expanding in the direction of said straight cylindrical waveguide at a gentle angle, and said second tapered portion being a sharply tapered waveguide connected to the fore end side of said gently tapered waveguide and expanding in a tapered form at an angle sharper than the expansion angle of said gently tapered waveguide; and the inside diameter of the connection of both said gently tapered and sharply tapered waveguides of said desired mode of electromagnetic wave generating portion being set larger than the inside diameter of said feed waveguide and smaller than 1.22 times the wavelength of a maximum frequency of the frequency band used.

6. A plural mode horn antenna according to claim 5, wherein said gently tapered waveguide has such a structure as to prevent the reflection of the electromagnetic wave in said desired mode of electromagnetic wave generating portion toward said feed waveguide to reduce the standing wave ratio, and said straight cylindrical waveguide has such a structure as to transmit toward the conical horn only the $TM_{11}$ mode electromagnetic wave as a higher mode on the basis of the $TE_{11}$ mode electromagnetic wave fed as the dominant mode from said straight cylindrical waveguide.

* * * * *

UNITED STATES PATENT AND TRADEMARK OFFICE

CERTIFICATE OF CORRECTION

PATENT NO. : 4,792,814

DATED : December 20, 1988

INVENTOR(S) : Takashi Ebisui

It is certified that error appears in the above-identified patent and that said Letters Patent is hereby corrected as shown below:

Top of column 1, in the title, "WAVESn" should be --WAVES--.
Column 2, line 14, "show" should be --shown--;
line 44, "srrface" should be --surface--.
Column 3, line 30, "elecrromagnetic" should be --electromagnetic--;
line 52, "$TE_{11}$" should be --$TE_{11}$°--;
line 66, "mmount" should be --amount--.
Column 5, line 17, "aas" should be --has--.
Column 7, line 56, "freuuency" should be --frequency--.
Column 9, line 15, "waveguid" should be --waveguide--;
line 52, "$80_m$" should be --$\lambda_m$--.
Column 10, line 43, "electromagentic" should be --electromagnetic--.

Signed and Sealed this

Thirtieth Day of April, 1991

*Attest:*

*Attesting Officer*

HARRY F. MANBECK, JR.

*Commissioner of Patents and Trademarks*